United States Patent [19]

Tokunaga et al.

[11] Patent Number: 4,888,068

[45] Date of Patent: Dec. 19, 1989

[54] PROCESS FOR MANUFACTURING PERMANENT MAGNET

[75] Inventors: Masaaki Tokunaga; Minoru Endoh; Noriaki Meguro; Shigeho Tanigawa, all of Saitama, Japan

[73] Assignee: Hitachi Metals, Ltd., Tokyo, Japan

[21] Appl. No.: 784,581

[22] Filed: Oct. 4, 1985

[30] Foreign Application Priority Data

Oct. 5, 1984 [JP] Japan ..... 59-209524

[51] Int. Cl.[4] ..... H01F 1/02

[52] U.S. Cl. ..... 148/104; 148/102; 148/103; 419/12; 419/29; 419/38; 419/54

[58] Field of Search ..... 148/105, 108, 102, 103, 148/104; 419/12, 29, 38, 54

[56] References Cited

U.S. PATENT DOCUMENTS 4,597,938 7/1986 Matsuura et al. ..... 419/23
4,601,875 7/1986 Yamamoto et al. ..... 419/23

FOREIGN PATENT DOCUMENTS 59-46008 3/1984 Japan .
59-64733 4/1984 Japan .
59-89401 5/1984 Japan .
59-219453 12/1984 Japan .

*Primary Examiner*—John P. Sheehan
*Attorney, Agent, or Firm*—Birch, Stewart, Kolasch & Birch

[57] ABSTRACT

A process for manufacturing a rare earth-iron-boron alloy permanent magnet by, after sintering, keeping the sintered alloy at temperatures of 750°-1000° C. for 0.2-5 hours, slowly cooling it at a cooling rate of 0.3°-5° C./min. to temperatures between room temperature and 600° C.; annealing it at temperatures of 550°-700° C. for 0.2-3 hours, and rapidly cooling it at a cooling rate of 20°-400° C./min. The permanent magnet contains a matrix, a B-rich phase and a Nd-rich phase. In grain boundaries of the matrix phases covered by bcc phases, thin, fine plates of the bcc phases projecting into the matrix phases are once increased by the first heat treatment and slow cooling and then eliminated by the annealing.

3 Claims, 4 Drawing Sheets

PROCESS FOR MANUFACTURING PERMANENT MAGNET

FIELD OF THE INVENTION

The present invention relates to a process for manufacturing rare earth permanent magnets. More specifically, it relates to a process for manufacturing permanent magnets containing a rare earth element, iron and boron through a particular heat treatment of a sintered body.

BACKGROUND OF THE INVENTION

Nd-Fe-B permanent magnet alloys have high residual flux density (Br) and high intrinsic coercivity (iHc), so that they have been receiving much attention as new permanent magnet materials which supplant conventional permanent magnets such as alnico magnets, hard ferrite magnets and Sm-Co magnets See Japanese Patent Laid-Open Nos. 59-46008, 59-64733 and 59-89401, and M. Sagawa et al., "New Material for Permanent Magnets on a Base of Nd and Fe," J. Appl. Phys. 55 (6) 2083 (1984). These Nd-Fe-B magnets consist essentially of 8–30 at % of Nd and/or Pr, 2–28 at % of B and balance Fe. They may contain additional elements such as Co., Al, Dy, Nb, Ti and Mo (Japanese Patent Laid-Open No. 59-219453).

Such permanent magnets may be prepared by powder metallurgy. Specifically speaking, component elements in a proper proportion are mixed and melted to form an ingot which is then pulverized and milled. The milled material is sintered and then heat-treated.

The heat treatment conditions may vary depending on the types of rare earth elements and the composition of magnets, but the Nd-Fe-B sintered magnets are usually annealed at temperatures of around 600° C. For instance, Sagawa et al. reported that the annealing at 590°–650° C. provides R-Fe-B magnets with intrinsic coercivity (iHc) of as high as almost 12 KOe. See J. Appl. Phys. 55 (6), 2086 (1984). These R-Fe-B alloys have (BH)max of up to about 35 MGOe, which is much higher than (BH)max of R-Co magnets which is at most about 30 MGOe.

However, Nd-Fe-B permanent magnets subjected to the conventional heat treatment have intrinsic coercivity (iHc) which varies widely depending on the composition, grain size, oxygen content and sintering temperature. In other words, the conventional heat treatment fails to draw sufficiently a potential iHc which such magnet materials inherently have.

OBJECT AND SUMMARY OF THE INVENTION

An object of the present invention is, therefore, to provide a process for manufacturing a rare earth-iron-boron permanent magnet with high intrinsic coercivity.

The process for manufacturing a permanent magnet according to the present invention is applicable to a magnetic alloy whose essential composition is represented by the general formula:

$$R(Fe_{1-x-y}Co_xB_y)z$$

wherein R represents Nd and/or Pr, which may be partially substituted by one or more other rare earth elements, $0 \leqq x \leqq 0.5$, $0.02 \leqq y \leqq 0.3$ and $4 \leqq z \leqq 7.5$, and comprises the steps of (a) after sintering, keeping the sintered alloy at temperatures of 750°–1000° C. for 0.2–5 hours; (b) slowly cooling it at a cooling rate of 0.3°–5° C./min to temperatures between room temperature and 600° C.; (c) annealing it at temperatures of 550°–700° C. for 0.2–3 hours; and (d) rapidly cooling it at a cooling rate of 20°–400° C./min.

DESCRIPTION OF THE PREFERRED EMBODIMENTS

Cobalt serves to elevate a Curie temperature of the rare earth-iron-boron permanent magnets, but when it exceeds 0.5 in the general formula, $4\pi$Ir and iHc of the magnets dramatically decreases, making them undesirable. Thus, cobalt should be 0.5 or less.

Boron should be 0.02–0.3 similarly in the general formula. When boron is lower than 0.02, the magnets do not have a high Curie temperature. On the other hand, when boron exceeds 0.3, Curie temperature and $4\pi$Ir of magnets decrease and there appear phases undesirable to magnetic characteristics in the magnets.

With respect to the atomic ratio Z of (FeCoB) to R, when Z is lower than 4, the magnets' $4\pi$Ir is low, but when it exceeds 7.5, the magnets have Fe, Co-rich phases reducing their iHc. Particularly when x is 0–0.3, y is 0.06–0.15 and Z is 5–6, good magnetic properties are obtained.

Besides the above essential components, the permanent magnet alloy may contain additional elements such as Al, Nb, Ti, Mo and Si. And it is noted that impurities inevitably contained in the alloy materials do not substantially affect the effects of the heat treatment according to the present invention.

The process of the present invention will be explained below.

First, component elements are mixed and melted in a inert gas or a vacuum. Ferroboron may be used as a boron component. The rare earth elements are preferably last introduced into a crucible. The resulting ingot is pulverized and milled into fine particles. This may consist of pulverization and milling. The pulverization may be carried out by a stamp mill, a jaw crusher, a brown mill, a disc mill, etc., and the milling may be carried out by a jet mill, a vibration mill, a ball mill, etc. In either case, the pulverization is carried out in a non-oxidating atmosphere to prevent the oxidation of magnet alloys. For this purpose, organic solvents and inert gas are preferably used. The preferred organic solvents include various alcohols, hexane, trichloroethane, trichloroethylene, xylene, toluene, fluorine-containing solvents, paraffin solvents. An average size of the resulting fine powders is 3–5 μm (FSSS).

The fine alloy powders thus prepared are compressed in a press in a magnetic field so that the resulting green body has its C-axis aligned in the same direction to show high magnetic anisotropy.

The green body is then sintered at 1050°–1150° C. for 30 minutes–3 hours in an inert gas such as Ar and He, or in hydrogen on in a vacuum.

Figure 1:
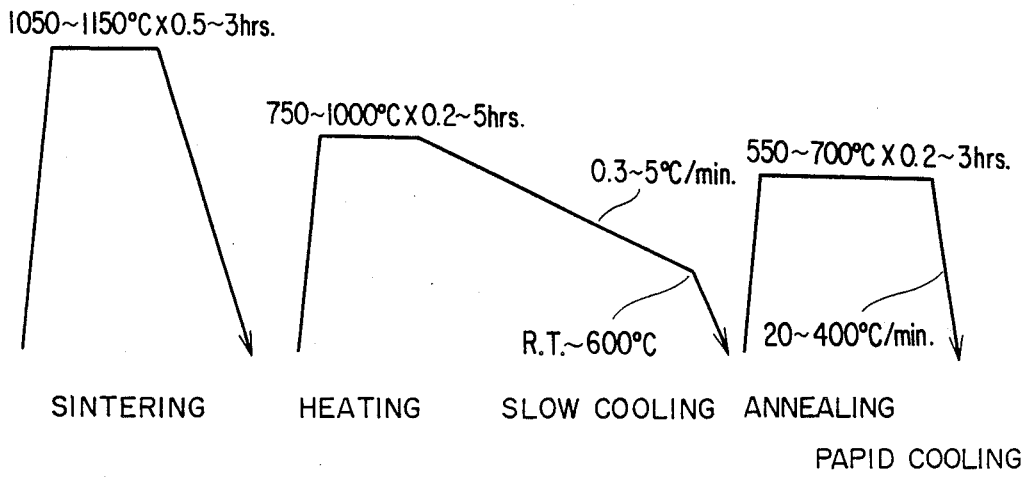
FIG. 1 schematically shows the process of the present invention.

FIG. 1 schematically shows the heat treatment of the present invention. In this embodiment, the alloy is cooled to room temperature after sintering for practical reasons. In this cooling step, a cooling speed does not substantially affect the intrinsic coercivity (iHc) of the final magnet. It is thus noted that the next heating step may be conducted directly after sintering without cooling down to room temperature.

The sintered alloy is then heated to 750°–1000° C. and kept at such temperature for 0.2–5 hours. When the above heating temperature is lower than 750° C. or higher than 1000° C., the resulting magnet does not have sufficiently high iHc.

After the above heating step, the sintered alloy is slowly cooled to temperatures between room temperature and 600° C. at a cooling rate of 0.3°–5° C./min. When the cooling rate exceeds 5° C./min., an equilibrium phase necessary for making the subsequent annealing effective cannot be obtained in the alloy, thus making it impossible to achieve sufficiently high iHc. On the other hand, when it is lower than 0.3° C./min., the heat treatment takes too much time, making the process less economical. The preferred cooling speed is 0.6°–2.0° C./min. The slow cooling is preferably performed to room temperature, but it can be stopped at 600° C., and then the alloy can be cooled down to room temperature relatively rapidly at the slight expense of iHc. The end temperature of the slow cooling is preferably 400° C.—room temperature.

The alloy is then annealed at 550°–700° C. for 0.2–3 hours. When the annealing temperature is lower than 550° C. or higher than 700° C., sufficiently high iHc cannot be achieved.

After annealing, the alloy is rapidly cooled- at a cooling rate of 20°–400° C./min. The rapid cooling may be conducted in water, a silicone oil or an argon gas. To retain the equilibrium phase obtained by the annealing, the cooling should be as quick as possible. However, when the cooling rate is higher than 400° C./min., the alloy tends to have cracking, making it difficult to provide commercially valuable permanent magnets. On the other hand, when the cooling rate is lower than 20° C./min. there appears in the alloy during the cooling process a new phase which is undesirable to iHc.

Figure 2:
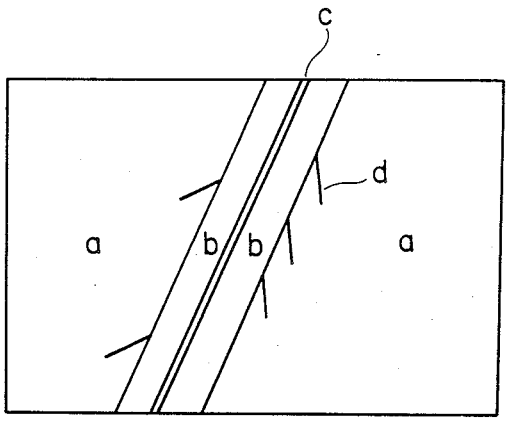
FIG. 2 is a schematic view showing the microstructure of an as-sintered alloy magnet.

Microscopically, the Nd-Fe-B alloy consists essentially of a matrix (main phase) consisting of $Nd_2Fe_{14}B$, a B-rich second phase consisting of $Nd_2Fe_7B_6$, and a Nd-rich third phase. Microscopic observation of an as-sintered Nd-Fe-B alloy reveals that in grain boundaries of the $Nd_2Fe_{14}B$ main phases each covered by a body-centered cubic (bcc) phase, thin, fine plates of the new bcc phase project into the main phases, causing deformation of the matrix lattices. This in turn reduces magneto-crystalline anisotropy of the magnetic alloy and causes the nucleation of reverse domains, providing such magnet with poor intrinsic coercivity. This is schematically shown by FIG. 2, in which phase a is the matrix (main phase) of $Nd_2Fe_{14}B$, phase b is the body-centered cubic (bcc) phase of about 50 Å—about 1000 Å in thickness, phase c is the Nd-rich phase of about 5 Å—about 700 Å in thickness, and d indicates a thin, fine plate of the phase b projecting into the matrix a.

Figure 3:
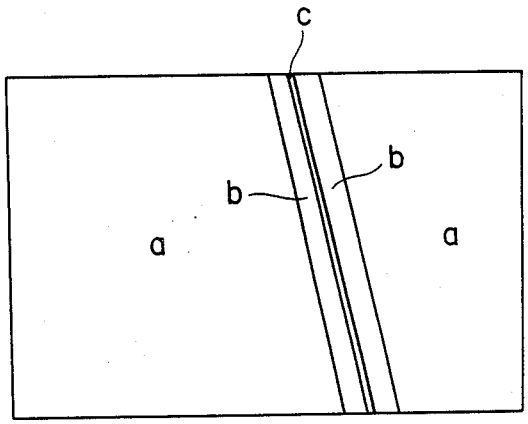
FIG. 3 is a schematic view showing the microstructure of a magnet manufactured by the process of the present invention.

It is observed that the annealing of the sintered Nd-Fe-B alloy at about 600° C. causes the thin, fine plates d to disappear in the grain boundaries of the matrix a, resulting in the elimination of the nucleation centers of reverse domains, which in turn enhances the intrinsic coercivity of the Nd-Fe-B magnet. The microstructure of the annealed Nd-Fe-B alloy is schematically shown by FIG. 3 in which the same symbols represent the same phases as in FIG. 2.

It is our outstanding finding that the magnetic properties, particularly intrinsic coercivity, of Nd-Fe-B alloy magnets are improved by performing the heat treatment consisting of (i) keeping the sintered alloys at 750°–1000° C. for 0.2–5 hours and (ii) slowly cooling them at 0.3°–5° C./min. to temperatures between room temperature and 600° C., between the sintering step and the annealing step. It is observed that the above heat treatment consisting of the two steps (i) and (ii) rather increases the number of thin, fine plates of the phase b projecting into the matrix a. After the annealing, substantially no thin, fine plates remain in the alloy. As far as the absence of such thin, fine plates is concerned, the alloy heat-treated according to the present invention does not substantially differ from that annealed after sintering. It should be noted, however, that once the number of such thin, fine plates is increased by the above two steps (i) and (ii), the intrinsic coercivity of the alloy is more improved after annealing than when the alloy is annealed after sintering. The present invention is based on the finding that a combination of the above heat treatment steps (i) and (ii) and the subsequent annealing step makes it possible to improve iHc much more than the annealing step alone. It may be considered that this finding is totally unpredictable from the microstructural point of view, because the above heat treatment step (ii) serves to increase the number of the thin, fine plates d which work to lower iHc.

The present invention will be explained in further detail by means of the following Examples.

EXAMPLE 1

An alloy having the composition of Nd $(Fe_{0.9}B_{0.1})_{5.5}$ was prepared by high-frequency melting. The resulting alloy ingot was pulverized by a stamp mill and a disc mill to 32 mesh or less, and then finely milled by a jet mill in a nitrogen gas to provide fine particles of 3.5-μm particle size (FSSS). The fine powders were pressed in a magnetic field of 15 KOe perpendicular to the compressing direction. The compression pressure was 2 tons/cm$^2$. The resulting green body was sintered at 1100° C. for 2 hours in vacuo, and then cooled in a cooling zone. A number of the resulting sintered alloys were respectively kept at various temperatures between 700° C. and 1080° C. for 1 hour (heating step), and then slowly cooled at 1.3° C./min. to 300° C. After cooling, the annealing at 600° C. for 1 hour was conducted on each sample. The samples were then rapidly cooled at about 300° C./min.

Figure 4:
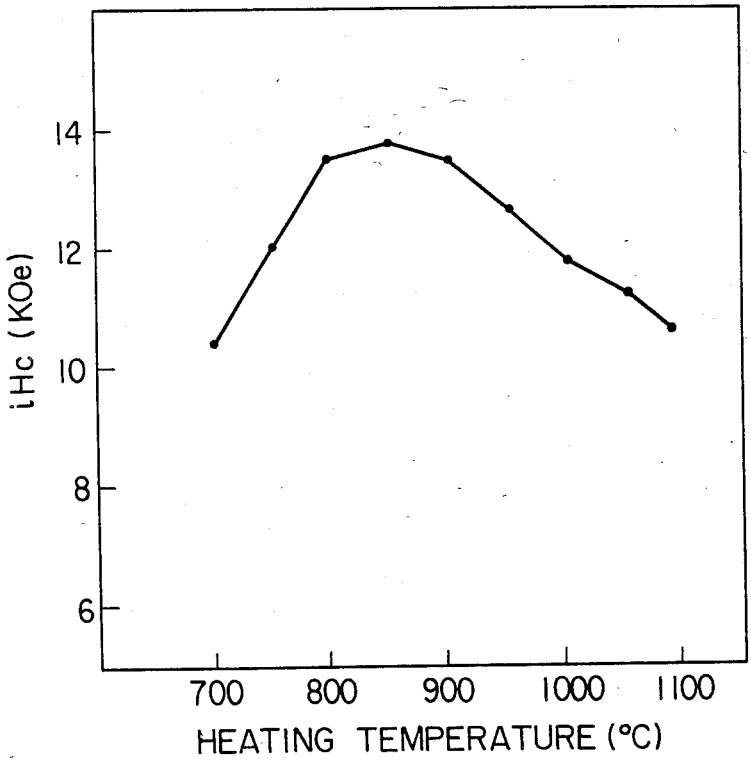
FIG. 4 is a graph showing the relationship between iHc and heating temperature in Example 1.

The relationship between the intrinsic coercivity (iHc) of the resulting magnets and the temperatures of the heating step is shown in FIG. 4. It is appreciated that when the heating temperature is kept between 750° C. and 1000° C., the magnets' iHc are about 12 KOe or higher.

On the other hand, when the magnet was prepared by annealing at 600° C. for 1 hour after quenching the sintered alloy according to the conventional process, it had 10.5-KOe iHc.

When the heating temperature was 850° C., the final magnet had the following magnetic characteristics:

Br~12100 G
bHc~10900 Oe
iHc~13700 Oe
(BH)max~35.7 MGOe

For the purpose of comparison, a magnet prepared by the above conventional process was measured with respect to its magnetic characteristics, which are:

Br~11900 G
bHc~10000 Oe
iHc~10500 Oe
(BH)max~34.7 MGOe

EXAMPLE 2

An alloy having the same composition as in Example 1 was sintered in the same way as in Example 1. The resulting sintered alloy samples were heated to and kept at 850° C. for 1 hour, and then slowly cooled at 1.3° C./min. to various temperatures of 800° C., 700° C., 600° C., 500° C., 400° C., 300° C., 200° C., 100° C. and room temperature. When the slow cooling was conducted to temperatures between 800° C. and 100° C., the alloy samples were cooled down to room temperature in an Ar gas flow. The slowly cooled samples were then subjected to annealing and rapid cooling as in Example 1.

Figure 5:
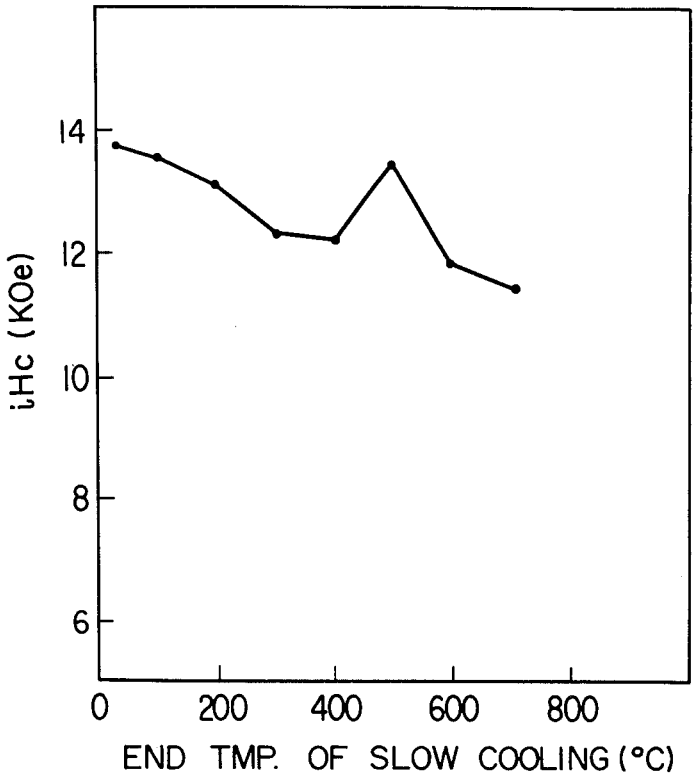
FIG. 5 is a graph showing the relationship between iHc and the end temperature of slow cooling in Example 2.

The relationship between iHc of the finally obtained magnet and the end temperature of slow cooling is shown in FIG. 5. It is evident from FIG. 5 that when the end temperature of slow cooling was between room temperature and 600° C., the resulting magnet had iHc of about 12 KOe or more.

When the slow cooling was conducted to 500° C., the resulting magnet had the following magnetic characteristics:

Br~12000 G
bHc~10500 Oe
iHc~13400 Oe
(BH)max~35.4 MGOe

EXAMPLE 3

An alloy having the formula: $(Nd_{0.86}Dy_{0.14})(Fe_{0.92}B_{0.08})_{5.4}$ was subjected to melting, pulverizing, milling, pressing and sintering in the same way as in Example 1. The resulting sintered alloy was heated to 900° C. and kept at that temperature for 2 hours, and then slowly cooled to 200° C. at 1° C./min. The alloys thus heat-treated were subjected to annealing at various temperatures between 500° C.–750° C. for 1 hour, and then rapidly cooled in a silicone oil. The magnetic properties of the resulting magnets are shown in Table 1 together with those by the conventional method.

TABLE 1

| Annealing Temp.(°C.) | Br (G) | bHc (Oe) | iHc (Oe) | (BH)max (MGOe) |
|---|---|---|---|---|
| 500 | 11420 | 11100 | 12000 | 33.2 |
| 550 | 11450 | 11150 | 18300 | 33.1 |
| 600 | 11400 | 11200 | 20200 | 33.0 |
| 650 | 11390 | 11300 | 21300 | 32.2 |
| 700 | 11400 | 11200 | 19000 | 32.1 |
| 750 | 11420 | 1100 | 13000 | 32.4 |

TABLE 1-continued

| Annealing Temp.(°C.) | Br (G) | bHc (Oe) | iHc (Oe) | (BH)max (MGOe) |
|---|---|---|---|---|
| * | 11430 | 10900 | 12000 | 32.1 |

*Conventional process

EXAMPLE 4

An alloy having the formula: Nd $(Fe_{0.92}B_{0.08})_{5.7}$ was sintered in the same way as in Example 1. The resulting sintered alloy samples were heated to 850° C. and kept at that temperature for 2 hours. They were then slowly cooled to 300° C. at 0.9° C./min. Further, they were anealed at 670° C. for 1 hour and rapidly cooled in either of water, a silicone coil or an Ar gas flow. The resulting magnetic charcteristics are shown in Table 2.

TABLE 2

| Rapid Cooling in | Cooling Rate (°C./min.) | Br (G) | hHc (Oe) | iHc (Oe) | (BH)max (MGOe) |
|---|---|---|---|---|---|
| Argon | 80 | 12300 | 11900 | 13000 | 35.9 |
| Silicone Oil | 200 | 12280 | 12000 | 13500 | 35.6 |
| Water | 350 | 12310 | 12100 | 14300 | 35.8 |

EXAMPLE 5

Alloys of various compositions were sintered in the same way as in Example 1. The resulting sintered alloy samples were heated to 900° C. and kept thereat for 3 hours, and then slowly cooled to 100° C. at 0.9° C./min. They were then annealed at 670° C. for 1 hour and rapidly cooled in a silicone oil. The resulting magnetic properties are shown in Table 3 as A together with those of the conventional process (B).

TABLE 3

| Composition | | Br (G) | bHc (Oe) | iHc (Oe) | (BH)max (MGOe) |
|---|---|---|---|---|---|
| $Nd_{0.7}Pr_{0.3}(Fe_{0.9}B_{0.1})_{5.7}$ | A | 12100 | 11800 | 16900 | 35.1 |
| | B | 12100 | 9800 | 10050 | 35.0 |
| $Nd_{0.6}Pr_{0.2}Ce_{0.2}$ | A | 11300 | 11000 | 13300 | 30.7 |
| $(Fe_{0.9}B_{0.1})_{5.4}$ | B | 11400 | 8700 | 9200 | 30.2 |
| $Nd_{0.9}Tb_{0.1}$ | A | 11450 | 11350 | 21500 | 31.7 |
| $(Fe_{0.91}B_{0.09})_{5.7}$ | B | 11380 | 11000 | 12100 | 31.5 |
| $Pr(Fe_{0.9}B_{0.1})_{5.2}$ | A | 11950 | 11500 | 18700 | 34.1 |
| | B | 11970 | 10500 | 11700 | 34.2 |
| $Nd(Fe_{0.8}Co_{0.1}B_{0.1})_{5.8}$ | A | 11750 | 11450 | 13600 | 33.4 |
| | B | 11710 | 11360 | 10700 | 33.6 |
| $Nd(Fe_{0.7}Co_{0.2}B_{0.1})_{5.6}$ | A | 11550 | 11410 | 14300 | 31.4 |
| | B | 11630 | 10700 | 11000 | 31.9 |

EXAMPLE 6

An alloy having the composition of Nd $(Fe_{0.9}B_{0.09})_{5.6}$ was subjected to melting and pulverizing and milling as in Example 1. In order to see how the oxidation of magnet materials affects their magnetic properties, the fine alloy powders were pressed in an atmosphere having various oxygen concentrations to provide green bodies of various oxygen contents. The green bodies were sintered at 1100° C. for 2 hours in vacuo. The sintered alloy samples were subjected to the heat treatment of the present invention and the conventional heat treatment, respectively. The conventional heat treatment consisted of the steps of annealing at 650° C. for 1 hour and rapidly cooling in an silicone oil. The heat treatment of the present invention here consisted of the steps of keeping at 870° C. for 1 hour, slowly cooling to 400° C. at 1.5° C./min., annealing at 650° C. for 1 hour and rapidly cooling in an silicone oil. The magnetic properties of magnet samples obtained by the method of the present invention (A) and the conventional method (B) are shown in Table 4.

TABLE 4

| Oxygen (ppm) | Heat Treatment | Br (G) | bHc (Oe) | iHc (Oe) | (BH)max (MGOe) |
|---|---|---|---|---|---|
| 7250 | A | 12200 | 12000 | 14900 | 35.3 |
| 7250 | B | 12270 | 11300 | 11980 | 35.0 |
| 8780 | A | 12000 | 12050 | 14500 | 35.2 |
| 8780 | B | 12150 | 7000 | 7500 | 34.7 |
| 9100 | A | 12100 | 11800 | 14300 | 34.8 |
| 9100 | B | 12300 | 5800 | 6200 | 32.5 |

As is evident from Table 4, the deterioration of magnetic properties by the presence of oxygen is extremely small in the present invention (A), while noticeable deterioration of bHc and iHc is appreciated in the conventional method (B). This means that when magnets are prepared through the heat treatment of the present invention, their magnetic properties are not substantially affected by how much oxygen is contained therein. This provides the benefit that oxygen needs not be so strictly controlled during pressing.

EXAMPLE 7

Figure 6:
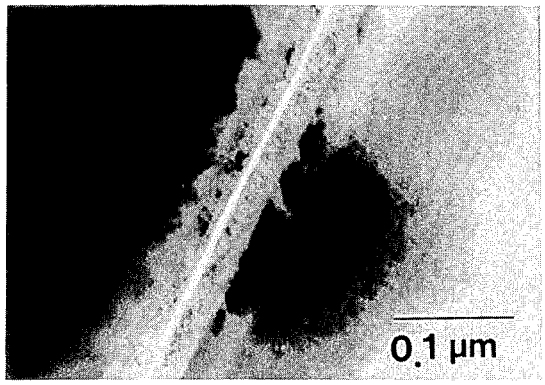
FIG. 6 is a TEM photomicrograph (200,000x) of the as-sintered sample in Example 7.

An alloy consisting of 8 at % B, 15 at % Nd, 0.01 at % Al and balance Fe was prepared, pulverized and milled to an average particle size of 5 μm. The resulting alloy powders were pressed under 3 tons/cm$^2$ in a magnetic field of 10 KOe to provide 200 green bodies which were then sintered at 1100° C. for 1 hour. Their transparent electron microscopy (TEM) gave FIG. 6 which is schematically shown by FIG. 2. It is observed that there are irregularities near the grain boundaries of the main phases a that the body-centered cubic phases b project into the main phases a as thin, fine plates d.

100 of these sintered alloy samples were subjected to the first heat treatment at 900° C. for 2 hours and the slow cooling a 1.5° C./min. Microscopic observation of these samples revealed that the number of the thin, fine plates d projecting into the main phases a increased.

Figure 7:
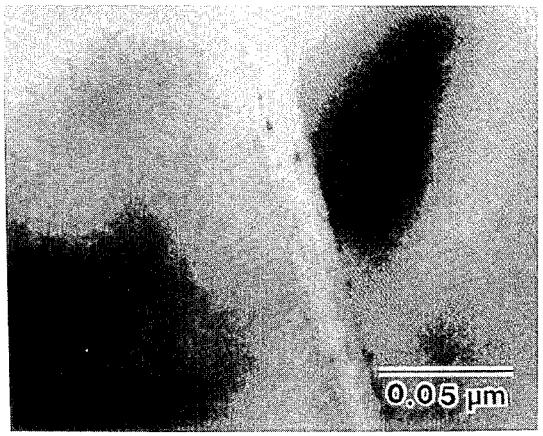
FIG. 7 is a TEM photomicrograph (400,000x) of the heat-treated sample in Example 7.
Figure 8:
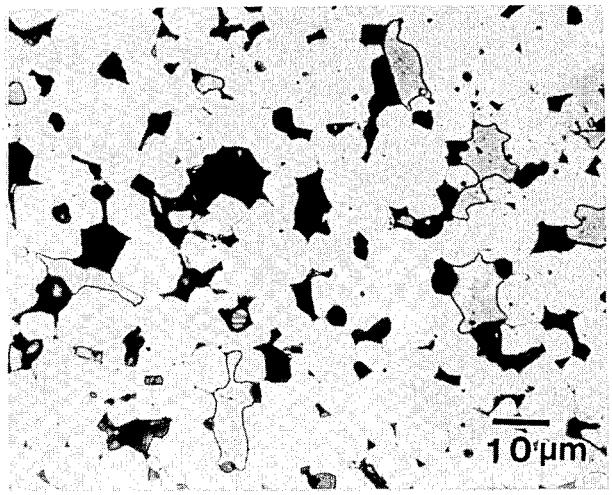
FIG. 8 is an optical photomicrograph of the heat-treated sample in Example 7.

The samples were further annealed at 660° C. for 1 hour and rapidly cooled. As shown by FIG. 7 which is a TEM photomicrograph (400,000x) of one sample, the finally heat-treated samples had no irregularities of the thin, fine plates d. The resulting magnets had iHc ranging 9,890–10,500 Oe and (BH)max ranging 33.0–36.8 MGOe. Incidentally, FIG. 8 shows an optical photomicrograph of one heat-treated sample in which white areas represent the main phases a, gray areas the B-rich phases and dark areas the Nd-rich phases.

COMPARATIVE EXAMPLE 100 of the sintered samples in Example 7 were subjected to the conventional heat treatment consisting of annealing at 660° C. for 1 hour and rapid cooling. Their microscopic observation revealed that there were no irregularities of the thin, fine plates d near the grain boundaries of the main phases a. However, their iHc was between 5000–9000 Oe, lower than the iHc of the samples heat-treated according to the present invention (Example 7).

The present invention has been explained by the above Examples, but it should be noted that the present invention is not restricted thereto, and that any alteration and modification may be made thereto unless it deviates from the scope and spirit of the present invention.

What is claimed is:

1. A process for manufacturing a sintered body of a permanent magnet having an alloy composition represented by the general formula $$R(Fe_{1-x-y}Co_xB_y)z$$

wherein R represents Nd and/or Pr which may be partially substituted by one or more other rare earth elements, $0 \leqq x \leqq 0.5$, $0.02 \leqq y \leqq 0.3$ and $4 \leqq z \leqq 7.5$, which comprises the steps of:

(a) maintaining a sintered alloy body at temperatures of 750°–1000° C. for 0.2—5 hours after sintering;

(b) cooling said sintered alloy body slowly at a cooling rate of 0.6°–2.0° C./min. to temperatures between room temperature and 600° C.;

(c) annealing said sintered alloy boby at temperatures of 550°–700° C. for 0.2–3 hours; and (d) cooling said sintered alloy body rapidly at a cooling rate of 20°–400° C./min.

2. The process for manufacturing a sintered body of a permanent magnet according to claim 1, wherein x i 0–0.3, y is 0.06–0.15 and z is 5–6.

3. The process for manufacturing a sintered body of a permanent magnet according to claim 1, wherein Step (d) is conducted in water, silicone oil or argon gas.

* * * * *